US008938841B1

(12) United States Patent
Ramirez

(10) Patent No.: US 8,938,841 B1
(45) Date of Patent: Jan. 27, 2015

(54) TOOTH BRUSHING SYSTEM

(71) Applicant: Jose A. Ramirez, Apple Valley, CA (US)

(72) Inventor: Jose A. Ramirez, Apple Valley, CA (US)

( * ) Notice: Subject to any disclaimer, the term of this patent is extended or adjusted under 35 U.S.C. 154(b) by 321 days.

(21) Appl. No.: 13/648,546

(22) Filed: Oct. 10, 2012

(51) Int. Cl.
*A46B 9/04* (2006.01)

(52) U.S. Cl.
USPC ..... 15/106; 15/167.1; 15/167.2; D4/111

(58) Field of Classification Search
CPC ..... A46B 5/0012; A46B 9/028; A46B 9/045
USPC ..... 15/167.1, 167.2, 159.1, 160, 106, 203; D4/111, 112, 105, 106
See application file for complete search history.

(56) References Cited

U.S. PATENT DOCUMENTS

| | | | | |
|---|---|---|---|---|
| 1,133,930 | A | 3/1915 | Carroll | |
| 1,671,891 | A * | 5/1928 | Dolan | 15/167.1 |
| 1,793,307 | A * | 2/1931 | Dolan | 15/188 |
| 2,090,663 | A | 8/1937 | Booth | |
| 2,771,624 | A | 11/1956 | Ripper | |
| 3,934,298 | A * | 1/1976 | Kim | 15/167.1 |
| 4,328,604 | A * | 5/1982 | Adams | 15/110 |
| 4,847,936 | A * | 7/1989 | Moglianesi et al. | 15/167.1 |
| 4,876,157 | A | 10/1989 | Barman | |
| D325,821 | S | 5/1992 | Schwartz | |
| 5,228,466 | A | 7/1993 | Klinkhammer | |
| 5,377,377 | A * | 1/1995 | Bredall et al. | 15/167.1 |
| 5,497,526 | A | 3/1996 | Klinkhammer | |
| 5,544,383 | A * | 8/1996 | Gamble | 15/106 |
| 5,842,249 | A | 12/1998 | Sato | |
| 6,138,689 | A | 10/2000 | Stern | |
| 6,957,467 | B2 * | 10/2005 | Cabedo-Deslierres et al. | 15/106 |
| 7,036,180 | B2 | 5/2006 | Hanlon | |
| 8,108,962 | B2 * | 2/2012 | Davidson et al. | 15/167.1 |
| 8,857,004 | B1 * | 10/2014 | Luis et al. | 15/167.1 |
| 2010/0275399 | A1 * | 11/2010 | Takahashi | 15/167.1 |
| 2012/0222229 | A1 * | 9/2012 | Maissami | 15/167.1 |

* cited by examiner

*Primary Examiner* — Laura C Guidotti

(57) ABSTRACT

A tooth brushing system for effectively removing debris and bacteria has an elongated linear handle with a conical flossing brush pivotally located on a handle second end. The system has a tooth brush head with a generally spherical surface with a brush head first side and a brush head second side each having a pair of angular notches and an angular secondary projection linearly located from the brush head top side to the brush head bottom side. A plurality of bristles of a first length is located on a tooth brush head spherical surface. A plurality of bristles of a second length, smaller than the first length, is located on the surfaces of the angular notches, and the angular secondary projections.

10 Claims, 3 Drawing Sheets

TOOTH BRUSHING SYSTEM

BACKGROUND OF THE INVENTION

Oral hygiene instruments have been around for a number of years, having been developed in an attempt to prolong the health and longevity of a person's teeth and gums. The toothbrush is one oral hygiene instrument used to clean the teeth and gums typically consisting of a bristled head mounted to an end of a handle. The present invention features a tooth brushing system for effectively removing debris and bacteria from hard to reach places on teeth in a human mouth.

SUMMARY

The present invention features a tooth brushing system for effectively removing debris and bacteria from hard to reach places on teeth in a human mouth. In some embodiments, the system comprises an elongated linear handle. In some embodiments, the system comprises a flossing brush pivotally located on the handle second end. In some embodiments, the flossing brush comprises a conical head. In some embodiments, a conical head is located on a conical head shaft first end. In some embodiments, the conical head shaft second end is pivotally located on a handle second end. In some embodiments, the flossing brush is adapted to fold flush into a cavity located in the linear handle close to the handle second end. In some embodiments, the conical head comprises flexible bristles located on the surface.

In some embodiments, the system comprises a tooth brush head having a generally spherical surface. In some embodiments, a brush head first side comprises a first pair of angular notches and a first angular secondary projection linearly located from the brush head top side to the brush head bottom side. In some embodiments, a brush head second side comprises a second pair of angular notches and a second angular secondary projection linearly located from the brush head top side to the brush head bottom side. In some embodiments, a plurality of bristles of a first length is located on a tooth brush head spherical surface. In some embodiments, a plurality of bristles of a second length, smaller than the first length, are located on the surfaces of the angular notches and the angular secondary projections.

In some embodiments, for use, the tooth brush head is placed into a human mouth. In some embodiments, the bristles of the tooth brush head are moved against teeth in a circular oscillatory manner via the user manipulating the handle to remove debris and bacteria. In some embodiments, the flossing brush is unfolded from a first compacted position to a second extended position. In some embodiments, the flossing brush is placed into the human mouth. In some embodiments, the bristles of the flossing brush head are moved against crevices in teeth in an oscillatory manner via the user manipulating the handle to remove debris and bacteria.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
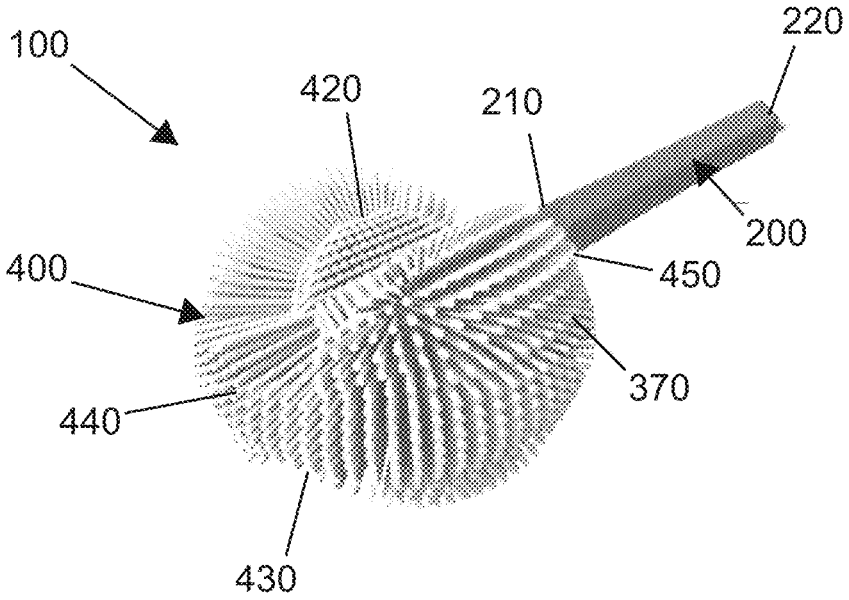
FIG. 1 is a perspective view of the present invention.
Figure 2:
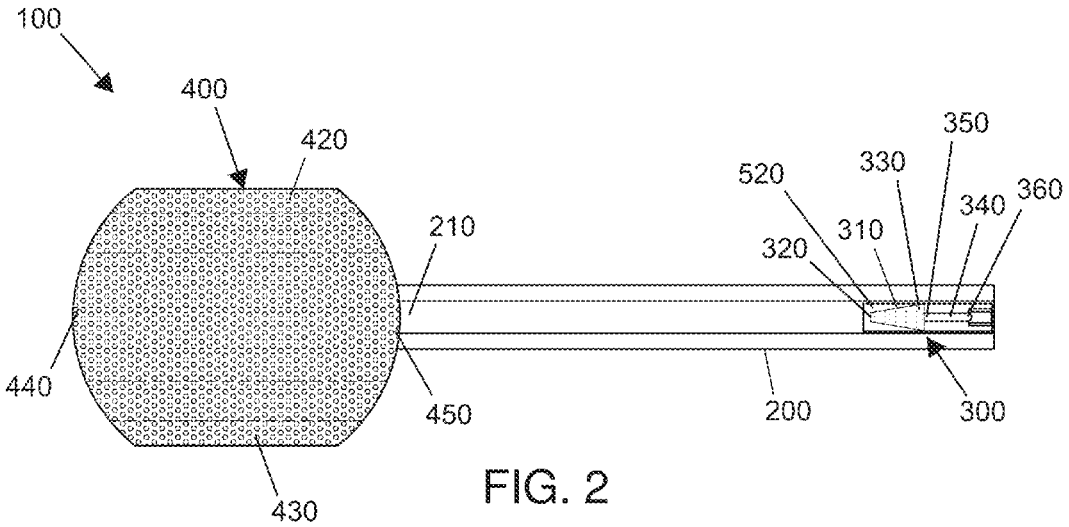
FIG. 2 is a side view of the present invention.
Figure 3:
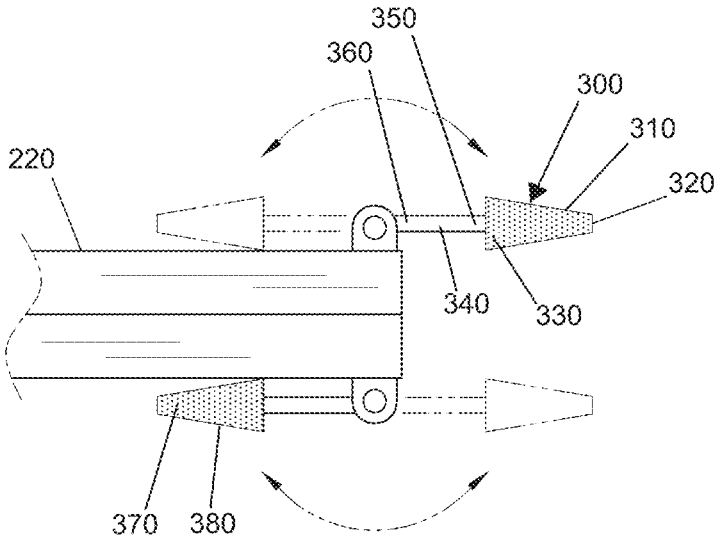
FIG. 3 is a view of the flossing brush of the present invention.
Figure 4:
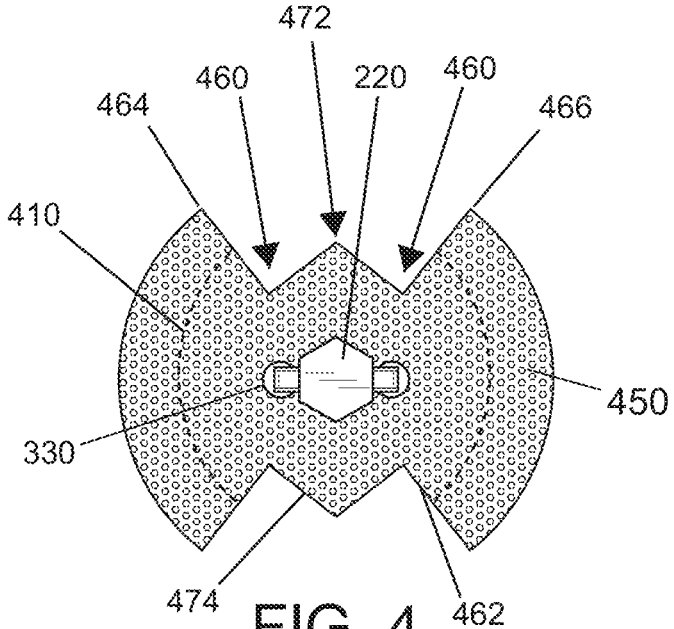
FIG. 4 is a bottom view of the present invention.
Figure 5:
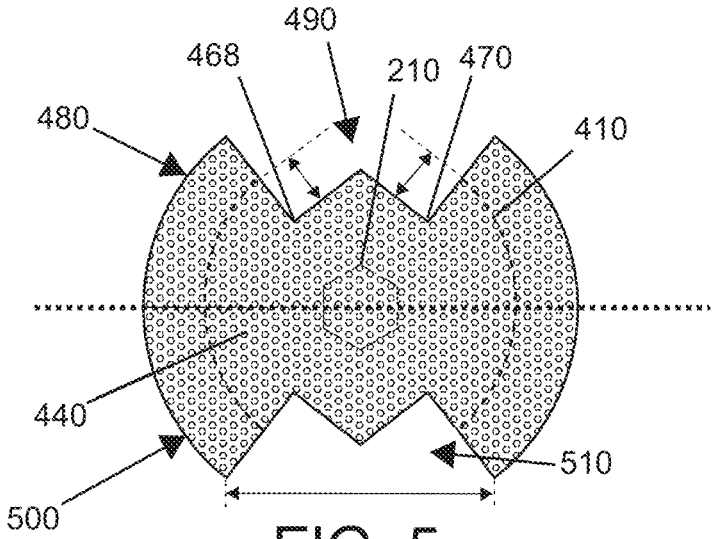
FIG. 5 is a top view of the present invention.

Following is a list of elements corresponding to a particular element referred to herein:

100 Tooth brushing system
200 Handle
210 Handle first end
220 Handle second end
300 Flossing brush
310 Conical head
320 Conical head first end
330 Conical head second end
340 Conical head shaft
350 Conical head shaft first end
360 Conical head shaft second end
370 Bristles
380 Conical head surface
400 Tooth brush head
410 Tooth brush head spherical surface
420 Brush head first side
430 Brush head second side
440 Brush head top side
450 Brush head bottom side
460 Angular notch
462 Angular notch surface
464 Angular notch first top edge
466 Angular notch second top edge
468 Angular notch first bottom
470 Angular notch second bottom
472 Angular secondary projection
474 Angular secondary projection surface
480 First side profile
490 First side recess
500 Second side profile
510 Second side recess
520 Cavity Referring now to FIG. 1-5, the present invention features a tooth brushing system (100) for effectively removing debris and bacteria from hard to reach places on teeth in a human mouth. In some embodiments, the system (100) comprises an elongated linear handle (200) having a handle first end (210) and a handle second end (220).

In some embodiments, the system (100) comprises a flossing brush (300) pivotally located on the handle second end (220). In some embodiments, the flossing brush (300) comprises a conical head (310) having a tipped, terminating conical head first end (320) and a conical head second end (330). In some embodiments, the conical head (310) is located on a conical head shaft first end (350). In some embodiments, the conical head shaft second end (360) is pivotally located on the handle second end (220). In some embodiments, the conical head (310) comprises flexible bristles (370) located on a conical head surface (380).

In some embodiments, the system (100) comprises a tooth brush head (400) having a generally spherical surface (410). In some embodiments, the tooth brush head (400) comprises a brush head first side (420), a brush head second side (430), a brush head top side (440) and a brush head bottom side (450). In some embodiments, the brush head first side (420) comprises a first pair of angular notches (460) and a first angular secondary projection (472) linearly located from the brush head top side (440) to the brush head bottom side (450). In some embodiments, the brush head second side (430) comprises a second pair of angular notches (460) and a second angular secondary projection (472) linearly located from the brush head top side (440) to the brush head bottom side (450). In some embodiments, the brush head bottom side (450) is located on handle first end (210). In some embodiments, the brush head top side (440) is a terminating end.

In some embodiments, a brush head cross-section in a transverse plane comprises a first side profile (480) resembling a semicircle having a first side recess (490) resembling a "W" and a second side profile (500) resembling a semicircle having a second side recess (510) resembling a "W". In some embodiments, a plurality of bristles (370) of a first length is isotropically located on a tooth brush head spherical surface (410). In some embodiments, a plurality of bristles (370) of a first length isotropically extend out and away from the tooth brush head spherical surface (410).

In some embodiments, the first side recess (490) is formed by a first pair of angular notches (460) and a first angular secondary projection (472). In some embodiments, the second side recess (510) is formed by a second pair of angular notches (460) and a second angular secondary projection (472).

In some embodiments, a plurality of bristles (370) of a second length, smaller than the first length, are located on the first pair of angular notch surfaces (462), the second pair of angular notch surfaces (462) the first angular secondary projection surfaces (474), and the second angular secondary projection surfaces (474). In some embodiments, a plurality of bristles (370) of a second length extend perpendicularly out and away from the first pair of angular notch surfaces (462), the second pair of angular notch surfaces (462), the first angular secondary projection surfaces (474), and the second angular secondary projection surfaces (474).

In some embodiments, a plurality of bristles (370) of a second length, smaller than the first length, are located on the first side first outside angular notch surface (462), the first side second outside angular notch surface (462), the first side first angular secondary projection surface (474), and the first side second angular secondary projection surface (474). In some embodiments, a plurality of bristles (370) of a second length extend perpendicularly out and away from the first side first outside angular notch surface (462), the first side second outside angular notch surface (462), the first side first angular secondary projection surface (474), and the first side second angular secondary projection surface (474). In some embodiments, a plurality of bristles (370) of a second length, smaller than the first length, are located on the second side first outside angular notch surface (462), the second side second outside angular notch surface (462), the second side first angular secondary projection surface (474), and the second side second angular secondary projection surface (474). In some embodiments, a plurality of bristles (370) of a second length extend perpendicularly out and away from the second side first outside angular notch surface (462), the second side second outside angular notch surface (462), the second side first angular secondary projection surface (474), and the second side second angular secondary projection surface (474).

In some embodiments, for use, the tooth brush head (400) is placed into a human mouth. In some embodiments, the bristles (370) of the tooth brush head (400) are moved against teeth in a circular oscillatory manner via a user manipulating the handle (200) to remove debris and bacteria. In some embodiments, the flossing brush (300) is unfolded from a first compacted position to a second extended position. In some embodiments, the flossing brush (300) is placed into the human mouth. In some embodiments, the bristles (370) of the conical head (310) are moved against crevices in teeth in an oscillatory manner via the user manipulating the handle (200) to remove debris and bacteria.

In some embodiments, a distance between a first side angular notch first top edge (464) and a first side angular notch second top edge (466) is about 12 millimeters. In some embodiments, a distance between a first side angular notch first top edge (464) and a first side angular notch second top edge (466) is about 10 millimeters. In some embodiments, a distance between a first side angular notch first top edge (464) and a first side angular notch second top edge (466) is about 14 millimeters.

In some embodiments, a distance between a second side angular notch first top edge (464) and a second side angular notch second top edge (466) is about 12 millimeters. In some embodiments, a distance between a second side angular notch first top edge (464) and a second side angular notch second top edge (466) is about 10 millimeters. In some embodiments, a distance between a second side angular notch first top edge (464) and a second side angular notch second top edge (466) is about 14 millimeters.

In some embodiments, a distance between the tooth brush head spherical surface (410) and a first side angular notch first bottom (468) is about 7 millimeters. In some embodiments, a distance between the tooth brush head spherical surface (410) and a first side angular notch first bottom (468) is about 8 millimeters. In some embodiments, a distance between the tooth brush head spherical surface (410) and a first side angular notch first bottom (468) is about 6 millimeters.

In some embodiments, a distance between the tooth brush head spherical surface (410) and a first side angular notch second bottom (470) is about 7 millimeters. In some embodiments, a distance between the tooth brush head spherical surface (410) and a first side angular notch second bottom (470) is about 8 millimeters. In some embodiments, a distance between the tooth brush head spherical surface (410) and a first side angular notch second bottom (470) is about 6 millimeters.

In some embodiments, a distance between the tooth brush head spherical surface (410) and a second side angular notch first bottom (468) is about 7 millimeters. In some embodiments, a distance between the tooth brush head spherical surface (410) and a second side angular notch first bottom (468) is about 8 millimeters. In some embodiments, a distance between the tooth brush head spherical surface (410) and a second side angular notch first bottom (468) is about 6 millimeters.

In some embodiments, a distance between the tooth brush head spherical surface (410) and a second side angular notch second bottom (470) is about 7 millimeters. In some embodiments, a distance between the tooth brush head spherical surface (410) and a second side angular notch second bottom (470) is about 8 millimeters. In some embodiments, a distance between the tooth brush head spherical surface (410) and a second side angular notch second bottom (470) is about 6 millimeters.

In some embodiments, the bristles (370) are nylon. In some embodiments, the bristles (370) are plastic. In some embodiments, the bristles (370) are natural fiber.

In some embodiments, the flossing brush (300) is adapted to fold flush into a cavity (520) located in the linear handle (200) close to the handle second end (220). In some embodiments, the system (100) comprises a plurality of flossing brushes (300) located on the handle second end (220), for example, two.

As used herein, the term "about" refers to plus or minus 10% of the referenced number. For example, an embodiment wherein the handle is about 10 inches in length includes a handle that is between 9 and 11 inches in length.

The disclosures of the following U.S. Patents are incorporated in their entirety by reference herein: U.S. Pat. No. 7,036,180; U.S. Pat. No. 6,138,689; U.S. Pat. No. 5,842,249; U.S. Pat. No. 5,497,526; U.S. Pat. No. 5,228,466; U.S. Pat. No. D325,821; U.S. Pat. No. 4,876,157; U.S. Pat. No. 2,771,624; U.S. Pat. No. 2,090,663; U.S. Pat. No. 1,133,930.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A tooth brushing system (100) for effectively removing debris and bacteria from hard to reach places on teeth in a human mouth, wherein said system (100) comprises:

(a) an elongated linear handle (200) having a handle first end (210) and a handle second end (220);

(b) a flossing brush (300) pivotally disposed on the handle second end (220), wherein the flossing brush (300) comprises a conical head (310) having a tipped, terminating conical head first end (320) and a conical head second end (330), wherein the conical head (310) is disposed on a conical head shaft first end (350), wherein the conical head shaft second end (360) is pivotally disposed on the handle second end (220), wherein the conical head (310) comprises flexible bristles (370) disposed on a conical head surface (380); and (c) a tooth brush head (400) having a generally spherical surface (410), wherein the tooth brush head (400) comprises a brush head first side (420), a brush head second side (430), a brush head top side (440) and a brush head bottom side (450), wherein the brush head first side (420) comprises a first pair of angular notches (460) and a first angular secondary projection (472) linearly disposed from the brush head top side (440) to the brush head bottom side (450), wherein the brush head second side (430) comprises a second pair of angular notches (460) and a second angular secondary projection (472) linearly disposed from the brush head top side (440) to the brush head bottom side (450), wherein the brush head bottom side (450) is disposed on the handle first end (210), wherein the brush head top side (440) is a terminating end, wherein a tooth brush head (400) cross-section in a transverse plane comprises a first side profile (480) resembling a semicircle having a first side recess (490) resembling a "W" and a second side profile (500) resembling a semicircle having a second side recess (510) resembling a "W", wherein a plurality of bristles (370) of a first length are isotropically disposed on a tooth brush head spherical surface (410), wherein a plurality of bristles (370) of a first length isotropically extend out and away from the tooth brush head spherical surface (410), wherein a plurality of bristles (370) of a second length, smaller than the first length, are disposed on a first side first outside angular notch surface (462), a first side second outside angular notch surface (462), a first side first angular secondary projection surface (474), and a first side second angular secondary projection surface (474), wherein the plurality of bristles (370) of the second length extend perpendicularly out and away from the first side first outside angular notch surface (462), the first side second outside angular notch surface (462), the first side first angular secondary projection surface (474), and the first side second angular secondary projection surface (474), wherein a plurality of bristles (370) of the second length, smaller than the first length, are disposed on a second side first outside angular notch surface (462), a second side second outside angular notch surface (462), a second side first angular secondary projection surface (474), and a second side second angular secondary projection surface (474), wherein the plurality of bristles (370) of the second length extend perpendicularly out and away from the second side first outside angular notch surface (462), the second side second outside angular notch surface (462), the second side first angular secondary projection surface (474), and the second side second angular secondary projection surface (474);

wherein for use, the tooth brush head (400) is placed into the human mouth, wherein the bristles (370) of the tooth brush head (400) are moved against teeth in a circular oscillatory manner via a user manipulating the handle (200) to remove debris and bacteria, wherein the flossing brush (300) is unfolded from a first compacted position to a second extended position, wherein the flossing brush (300) is placed into the human mouth, wherein the bristles (370) of the conical head (310) are moved against crevices in teeth in a oscillatory manner via the user manipulating the handle (200) to remove debris and bacteria.

2. The system (100) of claim 1, wherein a distance between a first side angular notch first top edge (464) and a first side angular notch second top edge (466) is about 12 millimeters.

3. The system (100) of claim 1, wherein a distance between a second side angular notch first top edge (464) and a second side angular notch second top edge (466) is about 12 millimeters.

4. The system (100) of claim 1, wherein a distance between the tooth brush head spherical surface (410) and a first side angular notch first bottom (468) is about 7 millimeters.

5. The system (100) of claim 1, wherein a distance between the tooth brush head spherical surface (410) and a first side angular notch second bottom (470) is about 7 millimeters.

6. The system (100) of claim 1, wherein a distance between the tooth brush head spherical surface (410) and a second side angular notch first bottom (468) is about 7 millimeters.

7. The system (100) of claim 1, wherein a distance between the tooth brush head spherical surface (410) and a second side angular notch second bottom (470) is about 7 millimeters.

8. The system (100) of claim 1, wherein the bristles (370) are nylon.

9. The system (100) of claim 1, wherein the flossing brush (300) is adapted to fold flush into a cavity (520) disposed in the linear handle (200) proximal to the handle second end (220).

10. The system (100) of claim 1, wherein the system (100) comprises a plurality of flossing brushes (300) disposed on the handle second end (220).

* * * * *